United States Patent [19]

Mourier

[11] 3,995,241

[45] Nov. 30, 1976

[54] DEVICE FOR ATTENUATING VERY SHORT PARASITIC WAVES IN ELECTRONIC TUBES WITH COAXIAL, CYLINDRICAL ELECTRODES

[75] Inventor: Georges Mourier, Paris, France

[73] Assignee: Thomson-CSF, Paris, France

[22] Filed: June 24, 1975

[21] Appl. No.: 589,889

[30] Foreign Application Priority Data

June 28, 1974 France ..... 74.22689

[52] U.S. Cl. ..... 333/81 A; 315/39; 315/39.51; 333/98 M

[51] Int. Cl.² ..... H01P 1/16; H01P 1/22

[58] Field of Search ..... 315/39, 39.51; 333/81 R, 81 A, 82 R, 82 B, 83 A, 98 M

[56] References Cited

UNITED STATES PATENTS

| | | | |
|---|---|---|---|
| 3,251,011 | 5/1966 | Unger | 333/83 A X |
| 3,395,314 | 7/1968 | Decker | 333/81 R X |
| 3,479,556 | 11/1969 | Cook | 315/39.51 |
| 3,634,790 | 1/1972 | Turteltaub | 333/82 B |

*Primary Examiner*—Paul L. Gensler
*Attorney, Agent, or Firm*—Roland Plottel

[57] ABSTRACT

The device in accordance with the invention comprises a conductor ring disposed coaxially to the two electrodes in such a fashion that the parasitic waves develop surface currents there, n absorptive elements distributed around said ring being provided in order to attenuate said surface currents; this device is applicable in particular to magnetrons or to tetrodes with cylindrical electrodes.

8 Claims, 13 Drawing Figures

DEVICE FOR ATTENUATING VERY SHORT PARASITIC WAVES IN ELECTRONIC TUBES WITH COAXIAL, CYLINDRICAL ELECTRODES

The present invention relates to devices suitable for arrangement in electronic tubes having coaxial cylindrical electrodes, in order to attenuate very short parasitic waves which can develop for example at the ends of said electrodes.

In certain electronic tubes, such for example as magnetrons or high frequency tetrodes, equipped with coaxial cylindrical electrodes, there are developed between certain parts of their coaxial electrodes which can be likened to waveguide sections, and in particular at their ends, waveguide modes exhibiting numerous resonances which it is highly desirable to suppress; these modes would seriously disturb the operation of such tubes if they were not suppressed.

These resonances which develop within the body of the tube itself, are generally within the very high frequency range or even in the microwave range, some hundreds of megahertz for example, due to the dimensions of the electronic tubes and the relatively simple form of their electrodes.

Systems for damping oscillations of this kind have already been proposed; they consist, for example, of the arrangement within the tube, at the locations where said unwanted oscillations develop, of highly damped oscillatory circuits. These systems exhibit several drawbacks. In particular, they have a narrow operating band width since the circuits involved are resonant circuits; this requires the utilisation of several different oscillatory circuits if several different parasitic resonances exist, and that is an expensive procedure, often indeed impossible in view of the small amount of space available within such tubes. They increase the number of resonances, too, which is undesirable.

The attenuator devices of the present invention are absorber devices, exhibiting no resonance within the operating band width of the tubes to which they are fitted. They are therefore capable of damping parasitic waves to different frequencies.

Since devices of this kind are capable of absorbing electromagnetic waves, very short waves or microwaves, within the whole of the operating band width of the tubes to which they are fitted, they must be arranged in these tubes in such a fashion as to absorb only the parasitic waves and not to attenuate the useful waves present in these tubes.

According to the invention, there is provided in an electronic tube having at least two coaxial cylindrical electrodes, a device for attenuating very short parasitic waves appearing at the ends of said coaxial electrodes comprising a metal ring having n elements capable of absorbing energy and uniformly distributed around said ring, said ring being disposed coaxially in relation to the said two electrodes in a region of the ends thereof at which said parasitic waves develop.

The invention, as well as illustrative embodiments, will now be described, reference being directed to the accompanying drawings in which.

Figure 1:
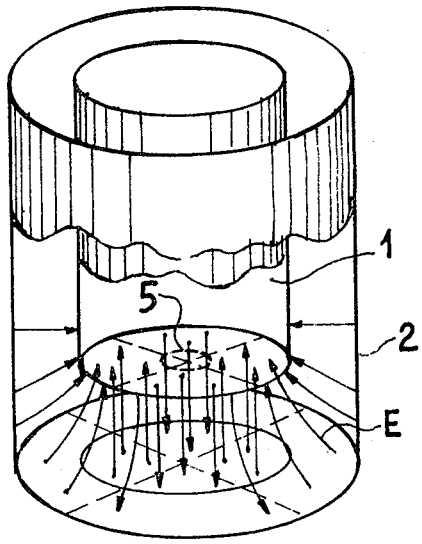
FIGS. 1, 2 and 3 are schematic illustrations of the distribution of the electric fields of parasitic oscillations at the ends of two closed, coaxial, cylindrical electrodes.
Figure 2:
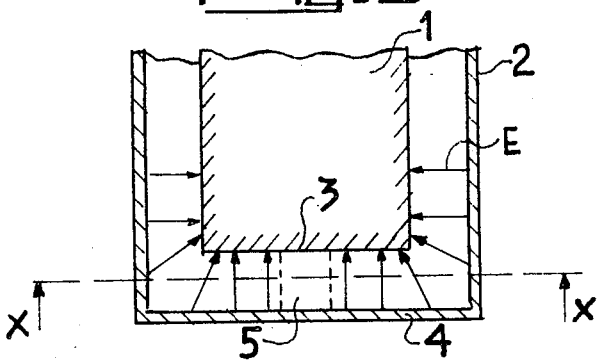
Figure 3:
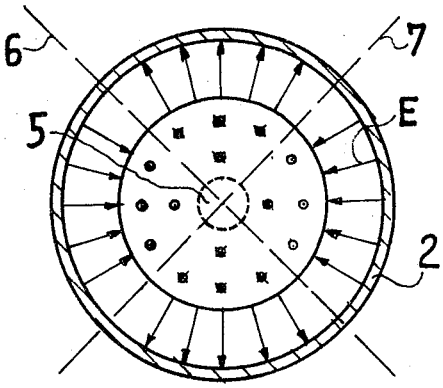

FIGS. 1, 2 and 3 schematically illustrate two coaxial, cylindrical electrodes respectively in perspective, longitudinal section and cross-section. These two electrodes are closed at at least one of their ends 3, 4; the central electrode 1 can furthermore be solid. The electrodes can be placed at different direct potentials or may instead be connected with one another. The first case is illustrated for example by the resonances of the terminal cavities of magnetrons, these cavities being comprised at each end of the tube, between the metal enclosure, the cathode and the anode block, or by the resonances of the terminal cavity of a tetrode with coaxial, cylindrical electrodes, between the anode and the screen-grid at those of the ends thereof not attached to the leads. The second case is encountered in particular in the space defined in tunable coaxial magnetrons, between the tuning piston and the external enclosure of the tube.

FIGS. 1, 2 and 3 represent a typical example of the shape of the electric field lines of a parasitic mode between two conductive walls such as those 1 and 2, closed at 3 and 4. In the present instance, we are concerned with a mode of azimuthal number 2 ($m = 2$) since there are two complete angular periods per revolution (FIG. 3 in particular). It is well-known that in such a case, and to a more marked extent for $m = 3, 4$ etc. as well as to a lesser extent for $m = 1$, the central space 5 defined by the broken lines plays a very minor part in the resonances in question.

As FIGS. 1 to 3 indicate, the resonant mode illustrated here divides the inter-electrode space into four sectors ($m = 2$), the electric field E, always normal to the conductive surfaces, changing its direction from one sector to the next. These four sectors are separated by two orthogonal node lines 6 and 7, at which the electric field cancels out. These electric fields of opposite sign from one sector to the next, oscillate in rhythm with the parasitic resonance which is to be attenuated (very high frequency or microwave frequency) and create at the conductive surfaces to which they are perpendicular, surface currents oscillating at the same frequency and whose lines of force are at right angles to the node lines 6 and 7 and are utilised by the attenuator devices in accordance with the invention.

In FIGS. 1 to 3, a single parasitic mode $m = 2$ and its two node lines 6 and 7, have been shown. In fact, there generally exist two simultaneous parasitic modes $m = 2$, each having two node lines at right angles, such as 6 and 7, the node lines of the second parasitic mode being at 45° to those, 6 and 7, of the first.

Figure 4:
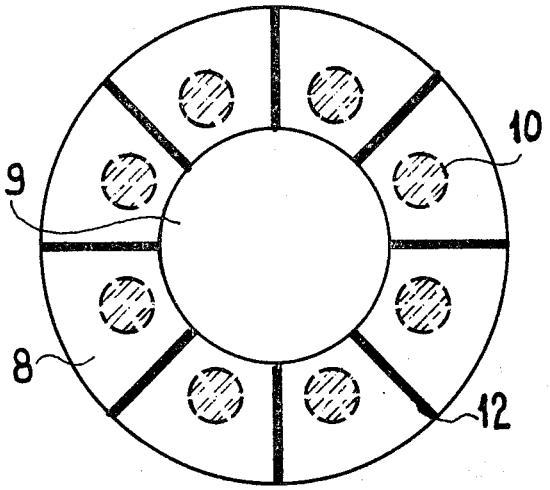
FIGS. 4, 5 and 6 are schematic views of an embodiment of an attenuator device in accordance with the invention, for electrodes such as those shown in FIGS. 1 to 3.
Figure 5:
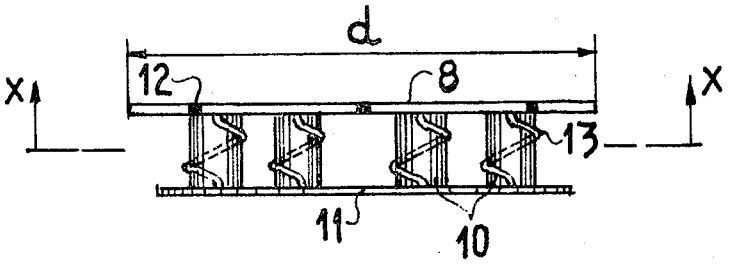
Figure 6:
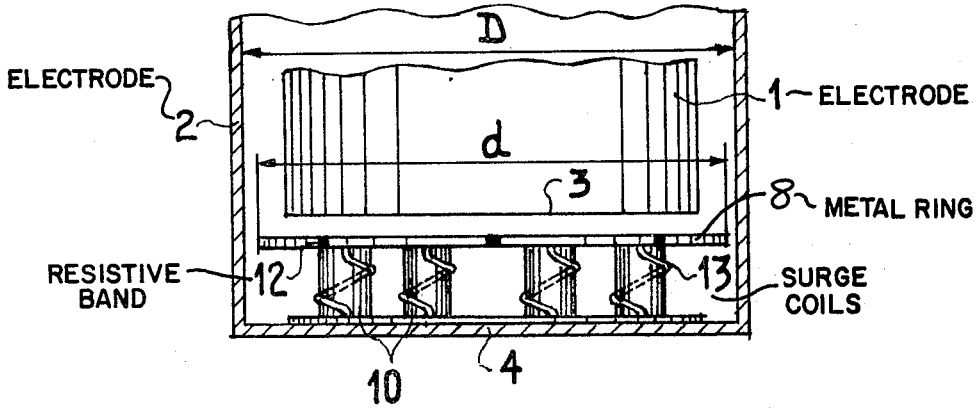

FIGS. 4 and 5 illustrate, in section and in side elevation, an attenuator device in accordance with the invention which is particularly well suited to the attenuation of parasitic modes $m = 2$ such as those described hereinbefore. FIG. 6 illustrates such a device installed in the inter-electrode space which gives rise to such parasitic modes.

The device consists primarily of a thin metal ring 8 the centre 9 of which, corresponding to the part 5 in FIGS. 1 to 3, can be opened out and the external diameter *d* of which is slightly smaller than the internal diameter D of the electrode 2.

This metal ring 8 is arranged between the parts 3 and 4 terminating the two electrodes 1 and 2, in fact parallel to these parts, so that it develops the same oscillatory surface currents as said parts 3 and 4.

For this purpose, the ring 8 is for example attached by insulating pillars 10 to a metal disc 11 which is brazed to the part 4 terminating the electrode 2.

The ring 8 also comprises several strips of resistive material 12 disposed radially and in this case interrupting the conductive ring over the whole of its thickness. The surface currents which circulate through the ring pass through these resistive bands and there dissipate their energy in the form of heat. The parasitic waves which give rise to these currents are thus attenuated.

These bands of resistive material whose dimensions and resistivity are chosen in order to achieve the desired overall damping effect, can be made for example of semi-conductive substances or of porous alumina filled with conductive or semi-conductive substances.

They may be constituted, as described here, by bands which interrupt the ring 8; they can equally well be constituted by the simple deposition of appropriate resistive material since it is surface currents which are involved.

The thermal energy dissipated by these bands 8 must, of course, be rapidly transferred to the tube exterior; the electrically insulating pillars 10 are consequently made of a material having high thermal conductivity, as for example alumina or beryllium oxide. Thus, the heat dissipated in the resistive bands 12 is removed by the metal parts of the ring 8 and then by the pillars 10, to the external electrode 2.

In the arrangement described here, in which the diameter *d* of the ring 8 is less than the internal diameter D of the electrode 2, so that the absorptive bands 12 are not partially short-circuited, something which would reduce their attenuating effect and in which the pillars 10 are electrically insulating in nature, the ring 8 is electrically isolated, something which can create serious risks in an electronic tube (accumulation of electrical charges, breakdown, etc. etc.) To overcome these drawbacks, the conductive parts of the ring 8 are electrically connected to the disc 11 and therefore to the base 4 of the electrode 2, through the medium of windings 13 which act as surge coils.

In another embodiment, the pillars 11 are constituted by an electrically conductive resistive material. In this case, the windings 13 are not necessary; moreover, the resistive pillars 11 themselves take part in the damping action, conducting and damping part of the surface currents in the ring 8.

As far as the number of resistive bands 12 is concerned, in the example of FIGS. 4 to 6, there are eight. This number is not imperative. However, it is advantageous in a situation where the parasitic modes present between such coaxial, cylindrical electrodes are, as mentioned before, two $m = 2$ modes having their node lines at 45°.

With the ring 8 split into eight identical sectors by eight resistive bands 12, efficient attenuation of the two modes is achieved. A ring with six bands and six sectors would damp one of the two modes less than the other but could still be used. With only four bands and four sectors, one of the modes would be unaffected by absorption which would make the device less relevant in the majority of applications.

Figure 7:
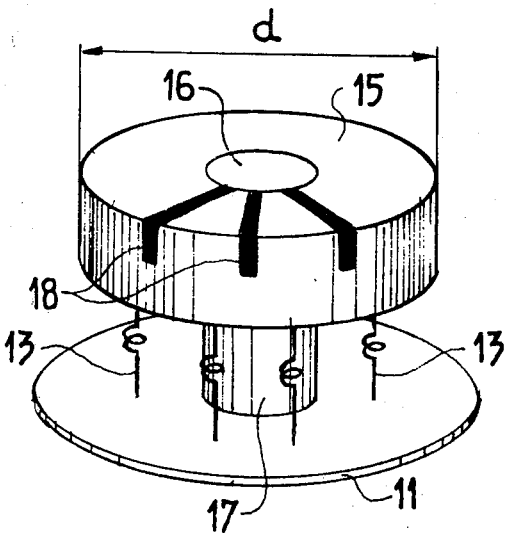
FIGS. 7 and 8 are schematic views of variant embodiment of the device shown in FIGS. 4 to 6.
Figure 8:
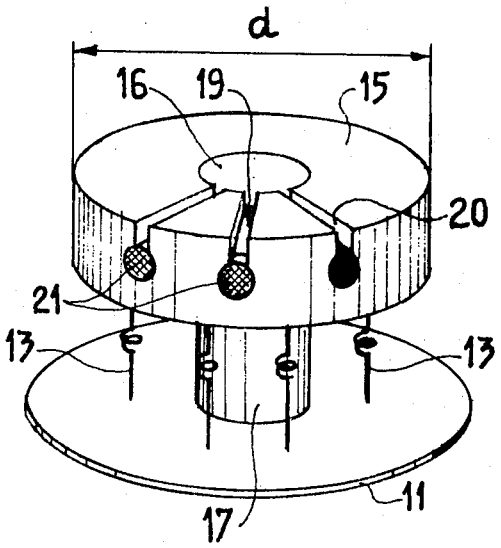

FIGS. 7 and 8 illustrate schematically variant embodiments of the attenuator device described in relation to FIGS. 4 to 5.

In these two FIGS. the thin ring 8 of FIGS. 4 to 6 is replaced by a thick ring 15 opened out at its centre 16 and having a diameter d less than the internal diameter of the electrode 2 in which it is arranged. This thick ring can be attached to a metal disc 11 either by using insulating or resistive pillars such as those of FIGS. 4 to 6, or by using a central hollow, electrically insulating pillar 17, as shown in FIGS. 7 and 8. The disc 11 is attached to the base 4 of the electrode 2 as in FIGS. 4 to 6. Windings 13 acting as surge coils, connect the ring 15 to the disc 11.

The resistive bands 12 of FIGS. 4 to 6 are replaced by magnetic loss elements having a very high resistivity, for example ferrites (elements 18 in FIG. 7 and 19 in FIG. 8), arranged in elongated openings formed in the ring 15 at the locations where the resistive bands were disposed in the case of FIGS. 4 to 6.

In FIG. 7, the elements 18 are parallepiped bars which are flush with the surface of the ring 15. In FIG. 8, these are cylindrical bars 19 located within the surface of the ring 15. In the latter case, in order to prevent the material of which the cylindrical bars 19 are made, from liberating gas to the tube enclosure when heated as a consequence of its magnetic loss characteristics, the bars can be enclosed in gastight enclosures. To do this, it is merely necessary to close off the top part 20 of the openings using plugs of electrically insulating material, for example ceramic, not shown here, and to close off the two lateral ends of each opening with likewise insulating plugs 21, the bars 19 to this end being shorter than the openings in which they are located.

The attenuator devices thus constituted, shown in FIGS. 7 and 8, are located between two electrodes 1 and 2 in the same fashion as in the device of FIG. 6, and therefore pass the same surface currents. But here the surface currents no longer flow through the radial resistive bands; they are constrained to flow round the bars 18 or 19 which are highly resistive. The current loops thus formed around these bars, create radial magnetic fields H there which generate in the bars magnetic loses giving rise to a development of heat and thus providing attenuation of the surface currents.

Figure 9:
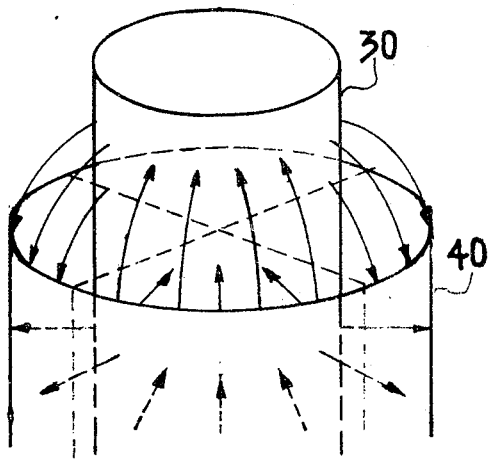
FIGS. 9, 10 and 11 are schematic illustrations of the distribution of the electric fields of parasitic oscillations at the ends of two coaxial, cylindrical electrodes, at least one of which is not closed.
Figure 10:
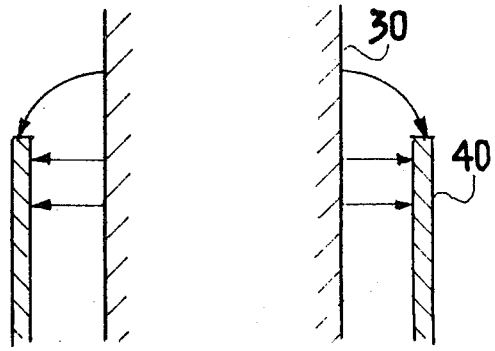
Figure 11:
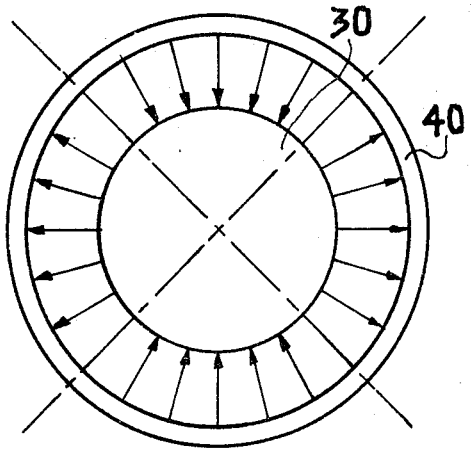

FIGS. 9, 10 and 11 schematically illustrate a typical embodiment of the configuration of the electric field of parasitic waves having a $m = 2$ mode, as described earlier, between two coaxial, cylindrical electrodes 30 and 40 which are not closed off. This kind of arrangement is encountered for example in a tetrode with coaxial electrodes, at the end at which the connections are made. Distribution of the fields due to the parasitic waves requiring attenuation, creates, as in FIGS. 1 to 3, currents at the mutually opposite surfaces of the electrodes 30 and 40. The flat ring 8 of FIGS. 4 to 6 is replaced in this case, as FIGS. 12 and 13 indicate, by a cylindrical ring 41 attached to the electrode 40 which it extends in the form of electrically insulating, thermally conductive pillars 42.

Figure 12:
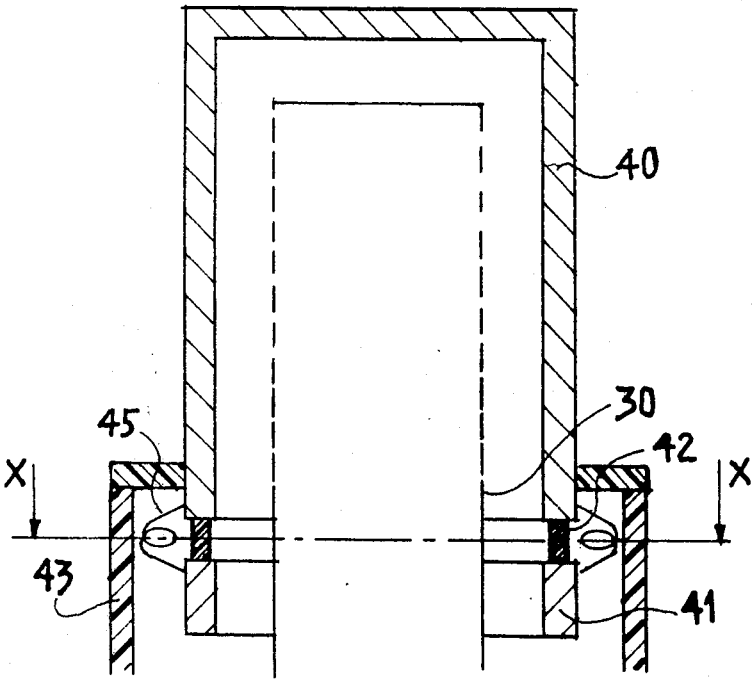
FIGS. 12 and 13 are schematic views of another embodiment of the attenuator device in accordance with the invention.

FIG. 12 illustrates this kind of attenuator device, fitted to the end of the anode 40 of a tetrode in which 30 is the screen-grid. At 43 there has been schematically illustrated the ceramic ring which conventionally seals the tube at that of its ends at which the leads are located (the latter not having been shown here).

Figure 13:
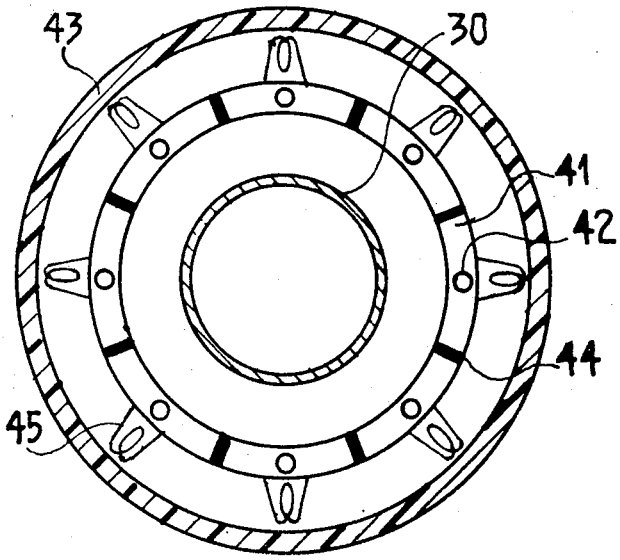

FIG. 13 is a section taken on the line XX, where a cylindrical ring 41 can be seen together with the resistive bands 44 which are equivalent to the resistive bands 12 of FIGS. 4 to 6.

Here, once again, in order to avoid the drawbacks which electrical insulation of the ring 41 and the electrodes would give rise to, windings 45 doing duty as surge coils connect each conductive sector of the ring 41 to the electrode 40. These windings are represented symbolically in FIG. 13, the electrode 40 to which they are connected, not being visible.

It will be observed that in the version just described, the pillars 42 were electrically insulating in nature; however, if the parasitic oscillations requiring suppression, in addition incorporate surface currents flowing parallel to the longitudinal axis of the electrodes 30 and 40, then it is desirable that said pillars should be made of a resistive material in order to participate in the attenuation of parasitic waves by attenuating said currents which are parallel to the axis.

It should also be noted that the cylindrical ring 41 of FIGS. 12 and 13, if it incorporates resistive bands 44 doing duty as absorptive elements, can, in a variant embodiment, comprise magnetic loss elements inserted in the ring 41 in the same fashion as the bars 18 or 19 of the ring 15 shown in FIGS. 7 and 8.

In the embodiments such as those of FIGS. 4, 5, 6 and 12, 13, where the conductive ring comprises resistive bands which interrupt the ring in its whole thickness, it is possible to provide means for avoiding dilatations and then detrimental mechanical stress, created by heatings when the parasitic waves are absorbed. Said means can consist in electrically conductive and rather flexible elements, such as metallic springs, each element being positioned between a resistive band and at least one of the ring portion to which said band is fixed.

What is claimed is:

1. In a high frequency electronic tube having at least two coaxial cylindrical electrodes, a device for attenuating very short parasitic waves appearing at the ends of said coaxial electrodes, said parasitic waves generating between said electrodes high frequency electric fields normal to said electrodes, said electric fields being spatially periodic around the longitudinal axis of said electrodes and having changing sign around said axis, said attenuating device comprising a metal ring equipped with a plurality of elements capable of absorbing energy, said ring being disposed coaxially in relation to said two electrodes in a region of their ends thereof at which said parasitic waves develop, said ring being attached to the outermost of said two electrodes, and said plurality of elements capable of absorbing energy being constituted by elongated bands radially disposed around said conducting ring with the same spatial periodicity as that of the electric fields to be attenuated, said ring being furthermore disposed in such a way that said elements are placed at points around said electrodes where the sign of said parasitic electric fields is changing due to its spatial periodicity.

2. An attenuator device as claimed in claim 1 wherein said ring is attached to the outermost of said two electrodes by at least one support of electrically insulating material having good thermal conductivity, and wherein surge coil windings are connected between said ring and said external electrode.

3. An attenuator device as claimed in claim 1, wherein said ring is attached to the outermost of the two said electrodes by at least one support of electrically resistive material having good thermal conductivity.

4. An attenuator device as claimed in claim 1, wherein said absorptive elements are bands of electrically resistive material dividing said ring into equal sections separated from one another over the whole of the thickness of said ring, by said bands.

5. An attenuator device as claimed in claim 1, wherein said absorptive elements are bands of electrically resistive material deposited at the surface of said ring facing the innermost electrode and dividing said surface into equal parts.

6. An attenuator device as claimed in claim 1, wherein said absorptive elements are bands of a material which is electrically non-conductive and exhibits magnetic losses, said bands being arranged around said ring in openings which create electrical discontinuities at the surface of said ring facing the innermost electrode.

7. An attenuator device as claimed in claim 1, wherein the two said electrodes being respectively closed at their end by a metal disc, said ring is a flat ring open at its centre and arranged between said two metal discs but not in electrical contact with said two electrodes.

8. An attenuator device as claimed in claim 1 wherein the end of at least the outermost electrode being open and the innermost electrode extending beyond the end of said outermost electrode, said ring is a cylindrical ring extending said outermost electrode and surrounding said innermost electrode.

* * * * *